US006915788B2

(12) United States Patent
Nakamura

(10) Patent No.: US 6,915,788 B2
(45) Date of Patent: Jul. 12, 2005

(54) ENGINE CONTROLLER

(75) Inventor: Michihisa Nakamura, Shizuoka-ken (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/476,772

(22) PCT Filed: Oct. 2, 2002

(86) PCT No.: PCT/JP02/10285

§ 371 (c)(1),
(2), (4) Date: Apr. 30, 2004

(87) PCT Pub. No.: WO03/033896

PCT Pub. Date: Apr. 24, 2003

(65) Prior Publication Data

US 2004/0194765 A1 Oct. 7, 2004

(30) Foreign Application Priority Data

Oct. 12, 2001 (JP) ..... 2001-315542

(51) Int. Cl.[7] ..... F02M 51/00
(52) U.S. Cl. ..... 123/488; 123/184.53
(58) Field of Search ..... 123/488, 184.53, 123/184.57; 73/118.2

(56) References Cited

U.S. PATENT DOCUMENTS 4,411,235 A 10/1983 Shinoda et al. ..... 123/488
4,412,520 A * 11/1983 Mitsuyasu et al. ..... 123/488
4,869,099 A * 9/1989 Takahashi et al. ..... 73/118.2
4,930,482 A 6/1990 Kako ..... 123/488
5,646,344 A 7/1997 Konzelmann ..... 73/204.18
6,453,897 B1 * 9/2002 Kanno ..... 123/684

FOREIGN PATENT DOCUMENTS

JP 05-059993 3/1993
JP 10-227252 8/1998
JP 2001-003804 1/2001
JP 122040 * 4/2002 ..... F02D/45/00

* cited by examiner

*Primary Examiner*—Hai Huynh
(74) *Attorney, Agent, or Firm*—Hogan & Hartson, LLP

(57) ABSTRACT

To provide a method of processing intake air pressure signals for accurately detecting the engine load including the accelerating state and the intake air flow rate from the intake air pressure.

Intake air pressure signals detected with an intake air pressure sensor 15 are processed with a low-pass filter. The low-pass filter is set to cut off frequencies that are not higher than the frequency corresponding to the wavelength that is four times the length of a pressure guide pipe 23 leading to the pressure sensor 15 and to cut off frequencies that are not lower than the driving frequency of the intake valve, which eliminates electric noises and air column vibration occurring in the pressure guide pipe 23 and makes it possible to obtain smooth and real changes in the intake air pressure commensurate with the strokes.

16 Claims, 11 Drawing Sheets

ENGINE CONTROLLER

FIELD OF THE INVENTION

The present invention relates to an engine controller for controlling an engine, in particular to a controller appropriate for controlling an engine provided with a fuel injection device that injects fuel.

TECHNICAL BACKGROUND

In recent years, along with the widespread use of the fuel injection device called an injector, control of fuel injection timing and injected fuel amount or an air-fuel ratio has become easy. As a result, it has become possible to increase output, reduce fuel consumption, and clean exhaust gasses. As for the fuel injection timing in particular, in strict terms the state of the intake valve or generally the camshaft phase is detected and fuel is injected according to the detected value. However, the so-called cam sensor for detecting the camshaft phase state is expensive and in most cases the cam sensor cannot be employed particularly in a motorcycle because of the problem of enlarged cylinder head. For that reason, a proposal of an engine controller is made, for example, in the patent publication JP-A-H10-227252, in which the crankshaft phase state and the intake air pressure are detected and from the detected values the cylinder stroke state is detected. Therefore, using the above-mentioned prior art, the stroke state can be detected without detecting the camshaft phase, so that fuel injection timing can be controlled according to the stroke state.

Incidentally, in order to control the amount of fuel injected from the above-described fuel injection device, for example it is possible to set a target air-fuel ratio according to the engine speed or the throttle opening, detect the actual intake air flow rate, and calculate a target fuel injection amount by multiplying the inverse of the target air-fuel ratio.

For detecting the intake air flow rate, a hot wire air flow sensor and a Karman vortex sensor are generally used to measure the mass flow rate and the volumetric flow rate, respectively. However, a volumetric member (surge tank) for restricting pressure pulsation is required to eliminate error factors due to reverse air flow, or it is required to install the sensor in a position the reverse air flow does not reach. However, most motorcycle engines are of the so-called independent intake type or the single cylinder type. Therefore, the above requirements cannot be met satisfactorily with most of the motorcycle engines, and the intake air flow rate cannot be detected accurately with the flow rate sensors mentioned above.

Another problem is that, since detection of the intake air flow rate is made at the end of an intake stroke or in the early period of a compression stroke when fuel has already been injected, the air-fuel ratio control using the intake air flow rate is effective only in the next cycle. This means that, before the next cycle, the air-fuel ratio is controlled according to the air-fuel ratio of the previous cycle in spite of the driver intending to accelerate and opening the throttle. Therefore, the driver will have a feeling of inconsistency because of insufficient acceleration due to insufficient torque or output. To solve such problems, the driver's intention for acceleration should be detected by detecting the throttle state using a throttle valve sensor or a throttle position sensor. However, such sensors cannot be employed especially in a motorcycle because of their large size and high price, and the problems remain unsolved at the moment.

Therefore, the following arrangement can be devised: the crankshaft phase and the intake air pressure in the intake pipe of a four-stroke engine are detected; an accelerating state is determined to be present when the differential value in the intake air pressure at the same crankshaft phase in the same stroke between the current cycle and the previous cycle is not smaller than a specified value; when an accelerating state is determined to be present, fuel is injected immediately from a fuel injection device, for example, so as to respond to the intention of the driver to accelerate. Here, smooth changes in the intake air pressure according to the stroke are required on one hand, and real changes in the intake air pressure are required when detecting the intake air flow rate on the other. In other words, intake air pressure changes that are smooth but real according to the stroke are required for detecting the accelerating state and the intake air flow rate of the engine, or the load. However, the presence of vibration in the intake air pressure detected with the pressure sensor has become known in addition to simple electric noises. The vibration hinders the detection of the intake air pressure changes according to the stroke.

The present invention has been developed to solve the above problems, with the object of providing an engine controller, which detects the engine load from the intake air pressure, controls the engine operating state according to the engine load, and can securely detect changes in the intake air pressure corresponding to the strokes during the control.

DISCLOSURE OF THE INVENTION

The claim 1 of the present invention relates to an engine controller for controlling the operating state of a four-stroke engine of the independent intake type according to the engine load detected from the intake air pressure in the intake pipe of the engine detected with a pressure sensor, characterized in that a low-pass filter is provided to apply low-pass filtering process to the intake air pressure signals detected with the pressure sensor, with the low-pass filter set to cut off frequencies that are not lower than the driving frequency of the intake valve.

The claim 2 of the present invention relates to an engine controller for controlling the operating state of a four-stroke engine of the independent intake type according to the engine load detected from the intake air pressure in the intake pipe of the engine detected with a pressure sensor, characterized in that a low-pass filter is provided to apply low-pass filtering process to the intake air pressure signals detected with the pressure sensor, with the low-pass filter set to cut off frequencies that are not higher than the frequency corresponding to the wavelength that is four times the length of a pressure guide pipe interconnecting the pressure sensor and the intake pipe and to cut off frequencies that are not lower than the driving frequency of the intake valve.

Incidentally, the term independent intake engine as used herein covers multi-cylinder engines having an independent intake system for each cylinder and single cylinder engines.

BEST FORM OF EMBODYING THE INVENTION

A form of embodying the present invention is described below.

Figure 1:
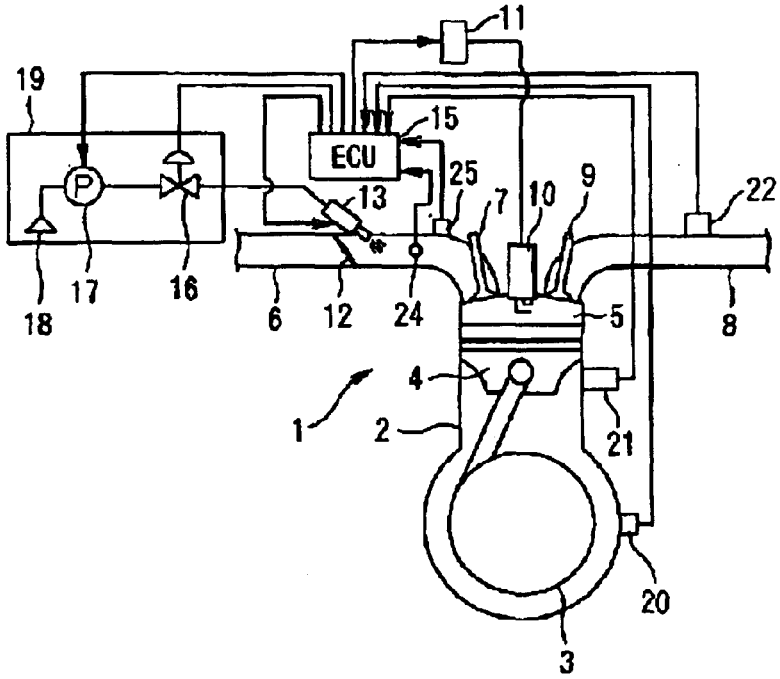
FIG. 1 is a simplified drawing of the constitution of a motorcycle engine and its controller.

FIG. 1 is a simplified drawing of an example constitution of a motorcycle engine and its controller. An engine 1 is a four-stroke engine with four cylinders. The engine 1 is also provided with: a cylinder body 2, a crankshaft 3, pistons 4, combustion chambers 5, intake pipes 6, intake valves 7, exhaust pipes 8, exhaust valves 9, ignition plugs 10, and ignition coils 11. A throttle valve 12 to be opened and closed according to the throttle opening is provided in the intake pipe 6. An injector 13, which serves as a fuel injection device, is provided in part of the intake pipe 6 on the downstream side of the throttle valve 12. The injector 13 is connected to a filter 18, a fuel pump 17, and a pressure control valve 16, provided in a fuel tank 19. Incidentally, the engine 1 is of the so-called independent intake type in which each cylinder sucks air independently of each other, and each intake pipe 6 of each cylinder is provided with one injector 13.

The operating state of the engine 1 is controlled with an engine control unit 15. In order to detect the operating state of the engine 1 by inputting control values to the engine control unit 15, the following sensors are provided: a crank angle sensor 20 for detecting the rotation angle or phase of the crankshaft 3, a cooling water temperature sensor 21 for detecting the temperature of the cylinder body 2 or the temperature of cooling water, that is, the temperature of the main part of the engine, an exhaust air-fuel ratio sensor 22 for detecting the air-fuel ratio in the exhaust pipe 8, intake air pressure sensors 24 for detecting intake air pressures in the intake pipes 6 of the respective cylinders, and intake air temperature sensors 25 for detecting temperatures of in the intake pipes 6, or the intake air temperatures. The engine control unit 15 is inputted with signals detected with those sensors and outputs control signals to the fuel pump 17, the pressure control valve 16, the injectors 13, and the ignition coils 11.

Figure 2:
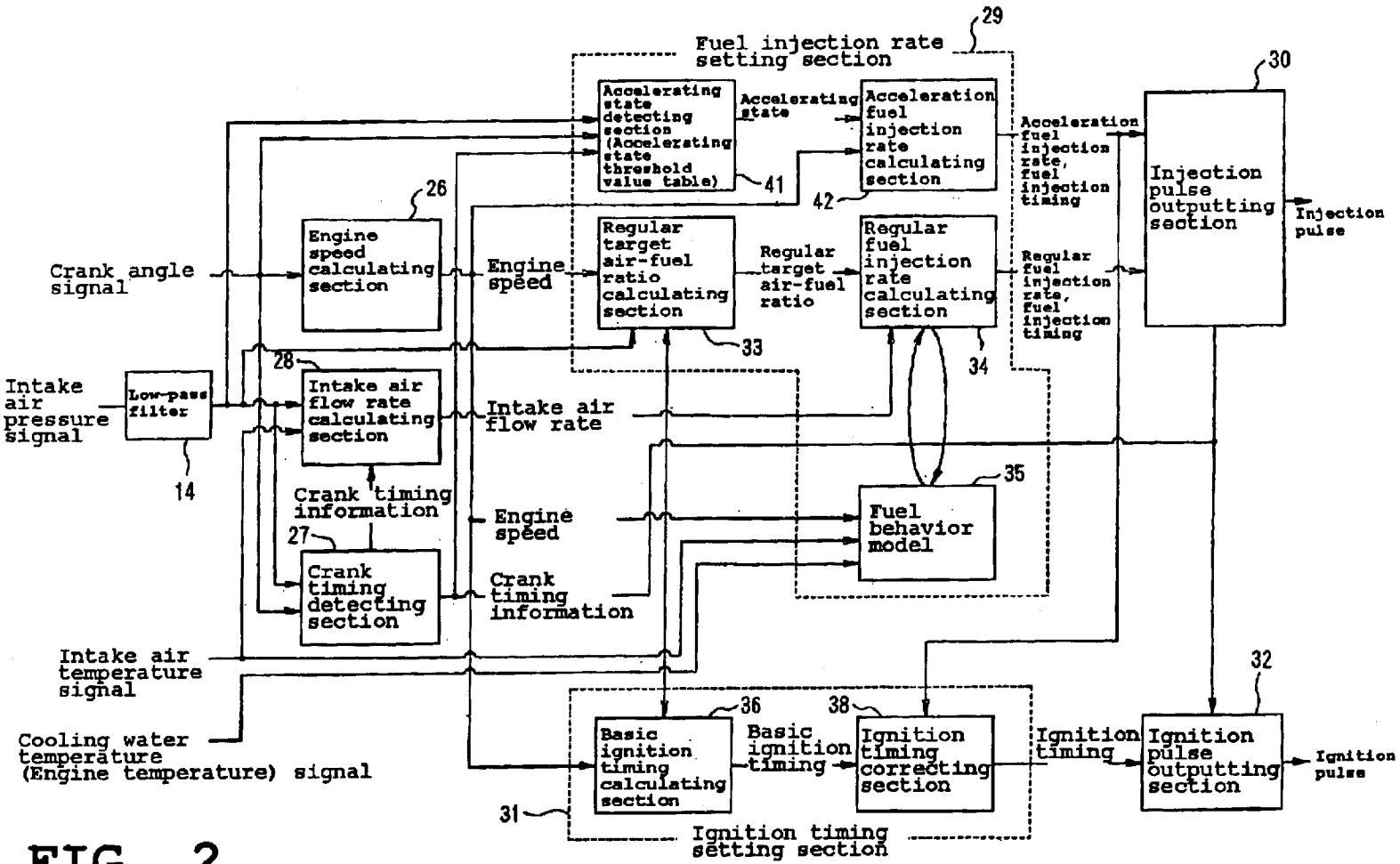
FIG. 2 is a block diagram of the engine controller as an embodiment of the present invention.

The engine control unit 15 is made up of a microcomputer and the like (not shown). FIG. 2 is a block diagram of the engine control operation process performed with the microcomputer in the engine control unit 15 as an embodiment of the present invention. The operation process is performed with the following components: a low-pass filter 14 for applying low-pass filtering process to the intake air pressure signals, an engine speed calculating section 26 for calculating the engine speed from the crank angle signal, a crank timing detecting section 27 for detecting crank timing information or the stroke state from the crank angle signal and the low-pass-filter-processed intake air pressure signal, an intake air flow rate calculating section 28 for loading the crank timing information detected with the crank timing detecting section 27 and calculating the intake air flow rate from the intake air temperature signal and the low-pass-filter-processed intake air pressure signal, a fuel injection rate setting section 29 for setting the target air-fuel ratio according to the engine speed calculated with the engine speed calculating section 26 and to the intake air flow rate calculated with the intake air flow rate calculating section 28 and calculating and setting fuel injection rate and fuel injection timing by detecting the accelerating state, an injection pulse outputting section 30 for loading the crank timing information detected with the crank timing detecting section 27 and outputting the injection pulse to the injector 13 according to the fuel injection rate and to the fuel injection timing set with the fuel injection rate setting section 29, an ignition timing setting section 31 for loading the crank timing information detected with the crank timing detecting section 27 and setting ignition timing according to the engine speed calculated with the engine speed calculating section 26 and the fuel injection rate set with the fuel injection rate setting section 29, and an ignition pulse outputting section 32 for loading the crank timing information detected with the crank timing detecting section 27 and outputting ignition pulses according to the ignition timing set with the ignition timing setting section 31 to the ignition coil 11.

The engine speed calculating section 26 calculates, from the time rate of change of the crank angle signal, the rotation speed of the crankshaft or the output shaft of the engine as the engine speed.

Figure 3:
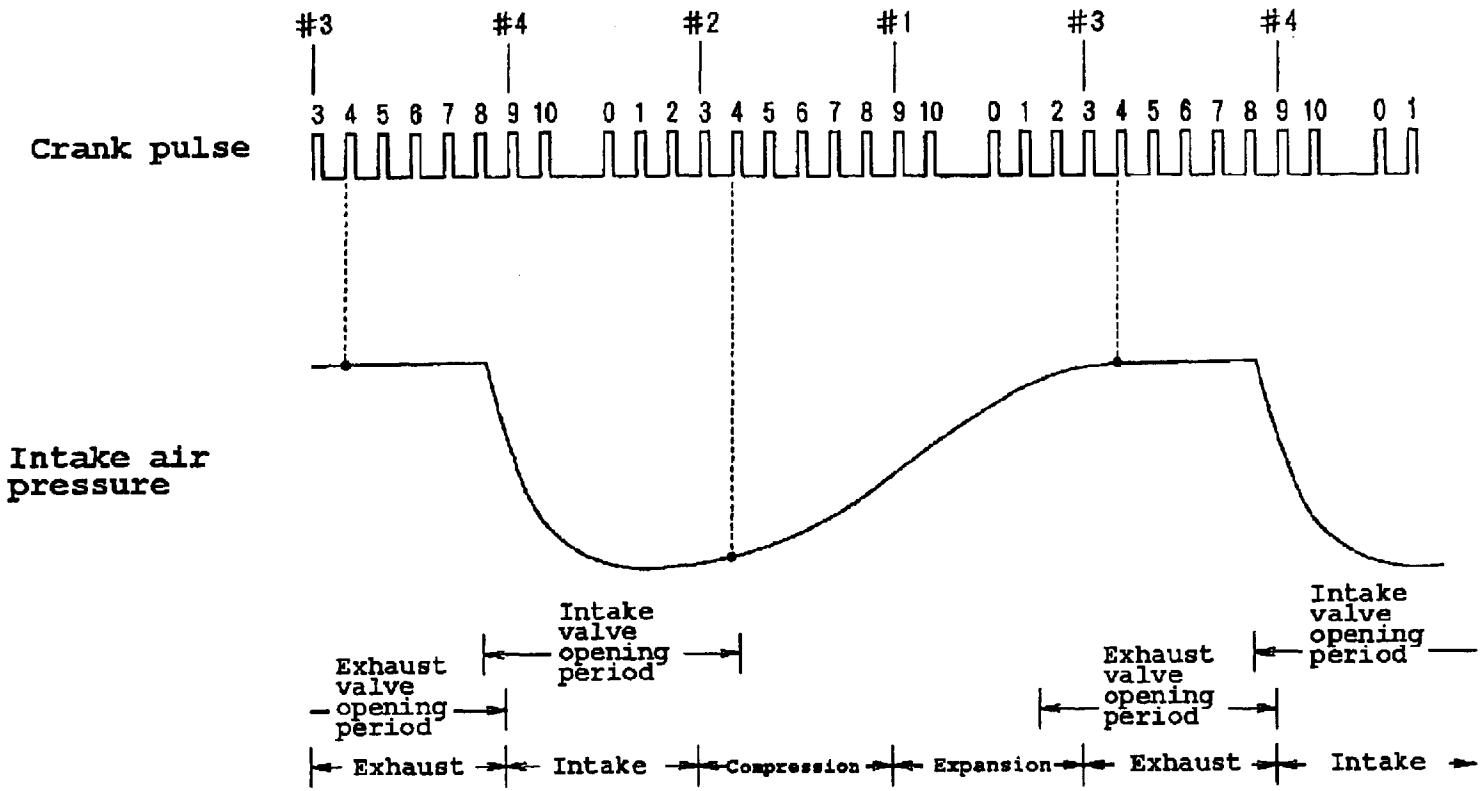
FIG. 3 is an explanatory drawing of detecting the stroke state from the crankshaft phase and the intake air pressure.

The crank timing detecting section 27 is of the same constitution as that of the stroke determining device described in the above-cited patent publication JP-A-H10-227252 to detect the stroke states of the cylinders as shown in FIG. 3 and outputs them as the crank timing information. In other words, the crankshaft and the camshaft of a four-stroke engine are continually running with a certain phase difference. When the crank pulses are loaded as shown in FIG. 3, the crank pulses indicated with the reference numerals '4' belong to either the exhaust or compression stroke. As is commonly known, in the exhaust stroke, since the exhaust valve is open and the intake valve is closed, the intake pressure is high. In the early period of the compression stroke, since the intake valve is still open, the intake pressure is low. Even if the intake valve is closed here, the intake pressure has decreased in the previous intake stroke. Therefore, the crank pulse indicated with '4' in the drawing when the intake pressure is low shows that the second cylinder is in the compression stroke and that the second cylinder is at the intake bottom dead center when the crank pulse indicated with '3' is obtained. In this way, when the stroke state of any cylinder is detected, states of other cylinders are known because they are in operation with certain phase differences. For example, the crank pulse indicated with '9' after the crank pulse indicated with '3' corresponding to the second cylinder at the intake bottom dead center corresponds to the intake bottom dead center of the first cylinder. The next crank pulse indicated with '3' corresponds to the intake bottom dead center of the third cylinder. The next crank pulse indicated with '9' corresponds to the intake bottom dead center of the fourth cylinder. The current stroke state can be detected more accurately by interpolating the state between adjacent strokes with the rotation speed of the crankshaft.

Figure 4:
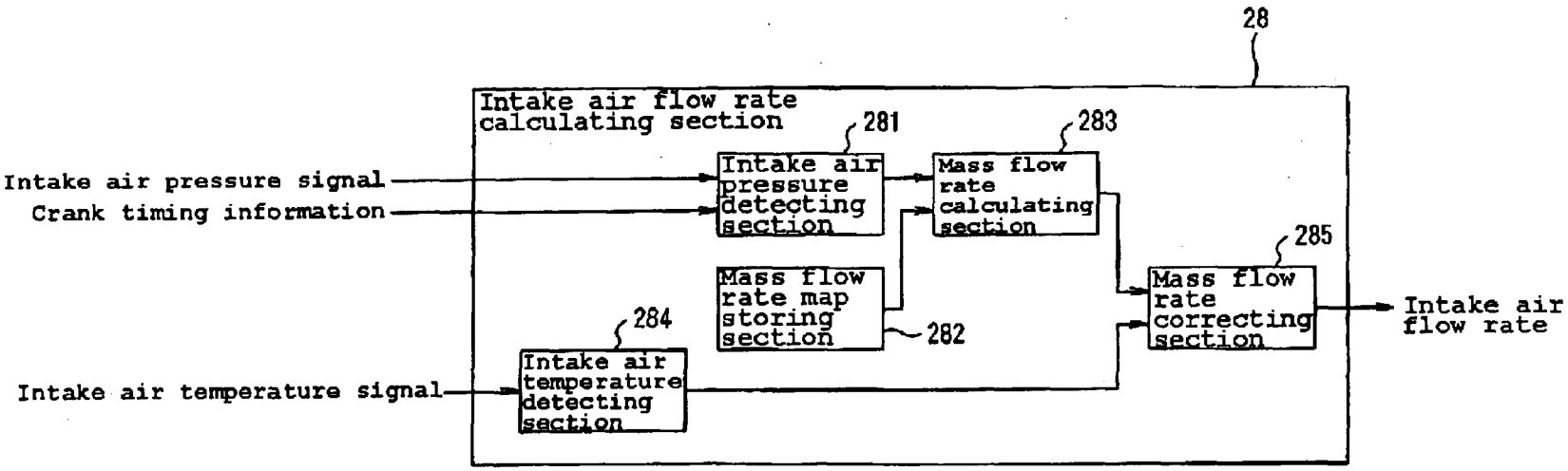
FIG. 4 is a block diagram of an intake air flow rate calculating section.

As shown in FIG. 4, the intake air flow rate calculating section 28 is made up of: an intake air pressure detecting section 281 for detecting the intake air pressure from the intake air pressure signal and the crank timing information, amass flow rate map storing section 282 for storing the map for detecting the mass flow rate of the intake air from the intake air pressure, a mass flow rate calculating section 283 for calculating the mass flow rate commensurate with the detected intake air pressure using the mass flow rate map, an intake air temperature detecting section 284 for detecting the intake air temperature from the intake air temperature signal, and a mass flow rate correcting section 285 for correcting the mass flow rate of the intake air using the mass flow rate of the intake air calculated with the mass flow rate calculating section 283 and the intake air temperature detected with the intake air temperature detecting section 284. In other words, since the mass flow rate map is organized with the mass flow rate at an intake air temperature of 20 degrees C., for example, actual intake air flow rate is calculated by correcting the map with the actual intake air temperature (absolute temperature ratio).

In this embodiment, the intake air flow rate is calculated using the intake air pressure value of the period from the bottom dead center of the compression stroke to the intake valve closing time point. That is to say, since the intake air pressure is nearly equal to the in-cylinder pressure when the intake valve is open, air mass in the cylinder can be calculated if the intake air pressure, the cylinder volume, and the intake air temperature are known. However, since the intake valve remains open for a while after the start of the compression stroke and air may move between the cylinder and the intake pipe, the intake air flow rate calculated from the intake air pressure for the period before the bottom dead center may differ from the actual flow rate at which air flows actually into the cylinder. Therefore, the intake air flow rate is calculated using the intake air pressure in the compression stroke during which air does not move between the cylinder and the intake pipe under the same condition of the intake valve remaining open. To obtain more accurate results, it is preferable to consider the effect of partial pressure of burned gas and use the engine speed having a high correlation with it to make correction commensurate with the engine speed measured in an experiment.

Figure 5:
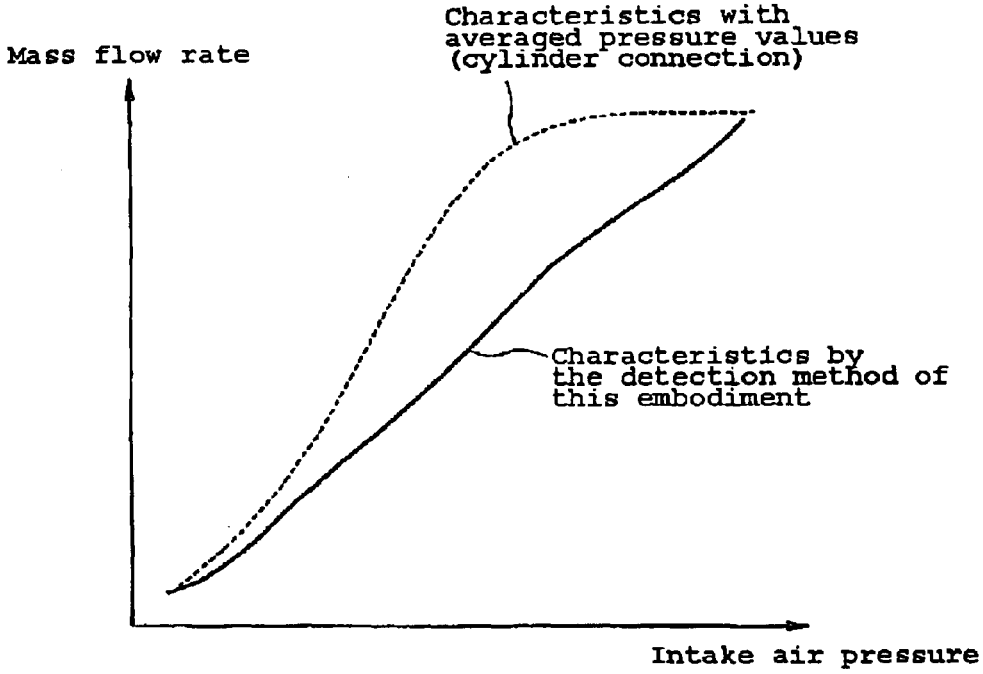
FIG. 5 is a control map for determining the mass flow rate of the intake air from the intake air pressure.

In this embodiment related to the independent intake type, the mass flow rate map nearly in linear relation to the intake air pressure as shown in FIG. 5 is used to calculate the intake air flow rate. This is because the air mass is calculated based on the Boyle-Charles's Law (PV=nRT). In contrast, in the case where an intake pipe is connected to all the cylinders, the map as shown with the broken line must be used because the premise of the intake air pressure being nearly equal to the in-cylinder pressure is not true due to the influence from other cylinders.

The fuel injection rate setting section 29 comprises: a regular target air-fuel ratio calculating section 33 for calculating regular target air-fuel ratio according to the engine speed calculated with the engine speed calculating section 26 and the intake air pressure signal, a regular fuel injection rate calculating section 34 for calculating the regular fuel injection rate and the fuel injection timing according to the regular target air-fuel ratio calculated with the regular target air-fuel ratio calculating section 33 and the intake air flow rate calculated with the intake air flow rate calculating section 28, a fuel behavior model 35 used in calculating the regular fuel injection rate and the fuel injection timing with the regular fuel injection rate calculating section 34, an accelerating state detecting means 41 for detecting the accelerating state from the crank angle signal, the intake air pressure signal, and the crank timing information detected with the crank timing detecting section 27, and an acceleration fuel injection rate calculating section 42 for calculating the acceleration fuel injection rate and fuel injection timing commensurate with the accelerating state calculated with the accelerating state detecting means 41 and the engine speed calculated with the engine speed calculating section 26. The fuel behavior model 35 is substantially integral with the regular fuel injection rate calculating section 34. That is to say, without the fuel behavior model 35, calculation and setting of the fuel injection rate and the fuel injection timing cannot be made accurately in this embodiment intended for injecting fuel into the intake pipes. Incidentally, the fuel behavior model 35 requires the intake air temperature signal, the engine speed, and the cooling water temperature signal.

Figure 6:
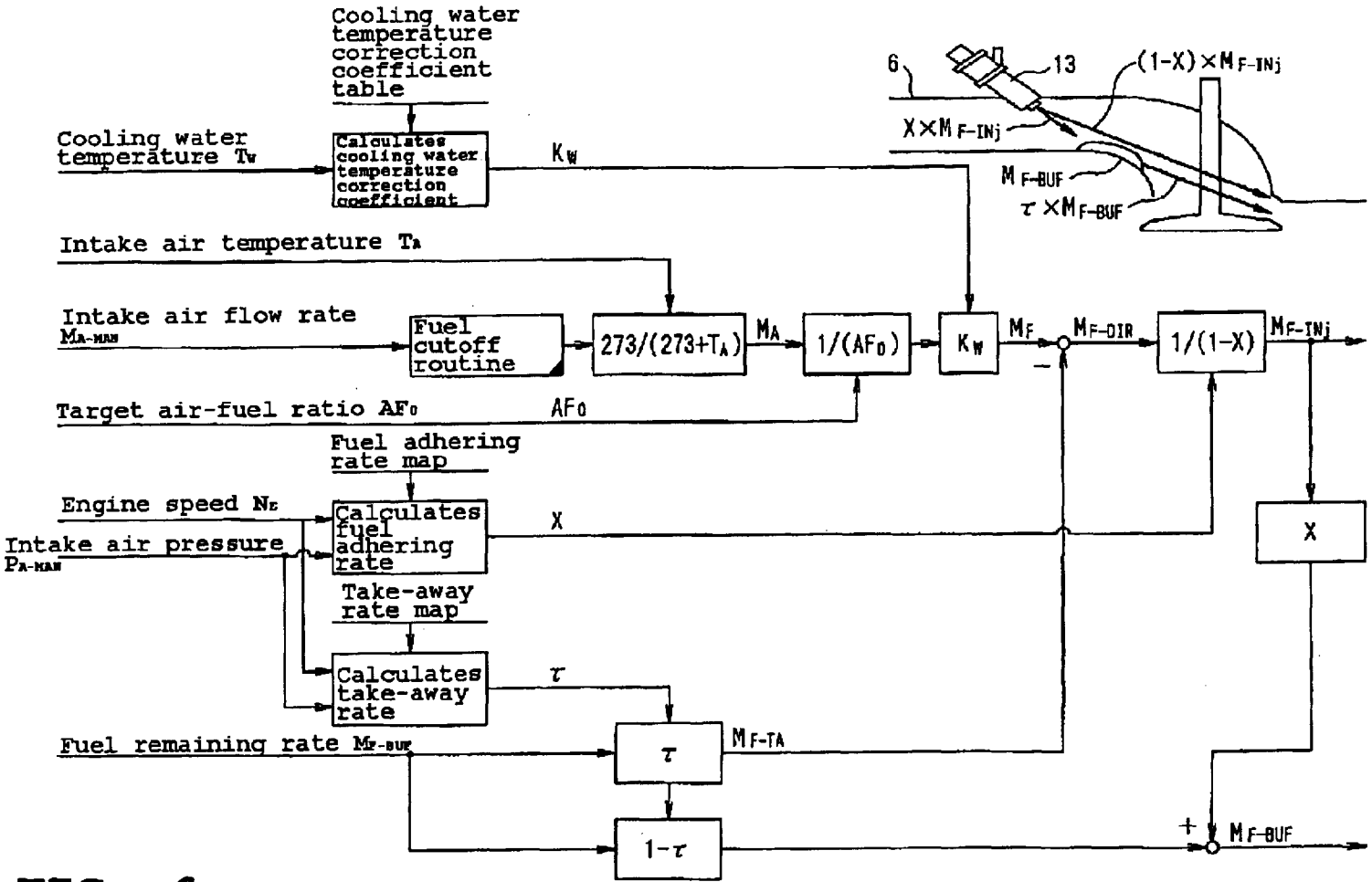
FIG. 6 is a block diagram of a fuel injection rate calculating section and a fuel behavior model.

The regular fuel injection rate calculating section 34 and the fuel behavior model 35 are constituted for example as shown in the block diagram of FIG. 6. Here, it is assumed that the rate of fuel injected from the injector 13 into the intake pipe 6 is $M_{F\text{-}INJ}$, of which the rate of fuel adhering to the wall of the intake pipe 6 is X. Then, of the $M_{F\text{-}INJ}$, the rate of fuel injected directly into the cylinder is $((1-X)\times M_{F\text{-}INJ})$. The rate of fuel adhering to the wall of the intake pipe 6 is $(X\times M_{F\text{-}INJ})$. Some of the adhering fuel flows along the intake pipe wall into the cylinder. Assuming the rate of remaining fuel to be $M_{F\text{-}BUF}$, and the rate of fuel taken away from the remaining fuel with intake air to be $\tau$, the rate of fuel taken away and flowing into the cylinder is $(\tau\times M_{F\text{-}BUF})$.

The regular fuel injection rate calculating section 34 first calculates a cooling water temperature correction coefficient $K_W$ from the cooling water temperature $T_W$ using a cooling water temperature correction coefficient table. Next, a routine of cutting fuel when, for example, the throttle opening is zero is applied to the intake air flow rate $M_{A\text{-}MAN}$. Next, an air inflow rate $M_A$, which is temperature-corrected using the intake air temperature $T_A$, is calculated, which is multiplied by the inverse ratio of the target air-fuel ratio $AF_0$ and further multiplied by the cooling water temperature correction coefficient Kw to obtain the required fuel inflow rate $M_F$. On the other hand, the fuel adhering rate X is calculated from the engine speed $N_E$ and the intake pipe pressure $P_{A\text{-}MAN}$ using the fuel adhesion rate map. Also from the engine speed $N_E$ and the intake pipe pressure $P_{A\text{-}MAN}$ and using the take-away rate map, the take-away rate $\tau$ is calculated. The fuel remaining rate $M_{F\text{-}BUF}$ obtained by the previous calculation is multiplied by the take-away rate $\tau$ to calculate the fuel take-away rate $M_{F\text{-}TA}$. This is subtracted from the required fuel inflow rate $M_F$ to obtain the direct fuel inflow rate $M_{F\text{-}DIR}$. As described before, the direct fuel inflow rate $M_{F\text{-}DIR}$ is (1−X) times the fuel injection rate $M_{F\text{-}INJ}$. Therefore, the regular fuel injection rate $M_{F\text{-}INJ}$ is calculated by dividing by (1−X). Of the fuel remaining rate $M_{F\text{-}BUF}$ remaining up to the previous time, $((1-\tau)\times M_{F\text{-}BUF})$ remains this time. Therefore, the fuel remaining rate $M_{F\text{-}BUF}$ this time is determined by adding the fuel adhering rate $(X\times M_{F\text{-}INJ})$.

The intake air flow rate calculated with the intake air flow rate calculating section 28 is the one detected at the end of the intake stroke that is one cycle earlier the intake stroke that is about to enter the combustion (expansion) stroke or at an early time of the compression stroke succeeding it. Therefore, also the regular fuel injection rate and the fuel injection timing calculated and set with the regular fuel injection rate calculating section 34 are the results of the previous cycle commensurate with the intake air flow rate.

The accelerating state detecting section 41has an accelerating state threshold value table. This table is used as will be described later when the intake air pressure differential between a stroke and the same stroke of the previous cycle at the same crank angle is obtained and compared with a given threshold value to detect the presence of an accelerating state. The threshold value varies with the crank angle. Therefore, an accelerating state is determined by comparing the differential between the current and previous intake pressure values with the given value that varies depending on the crank angle.

Figure 7:
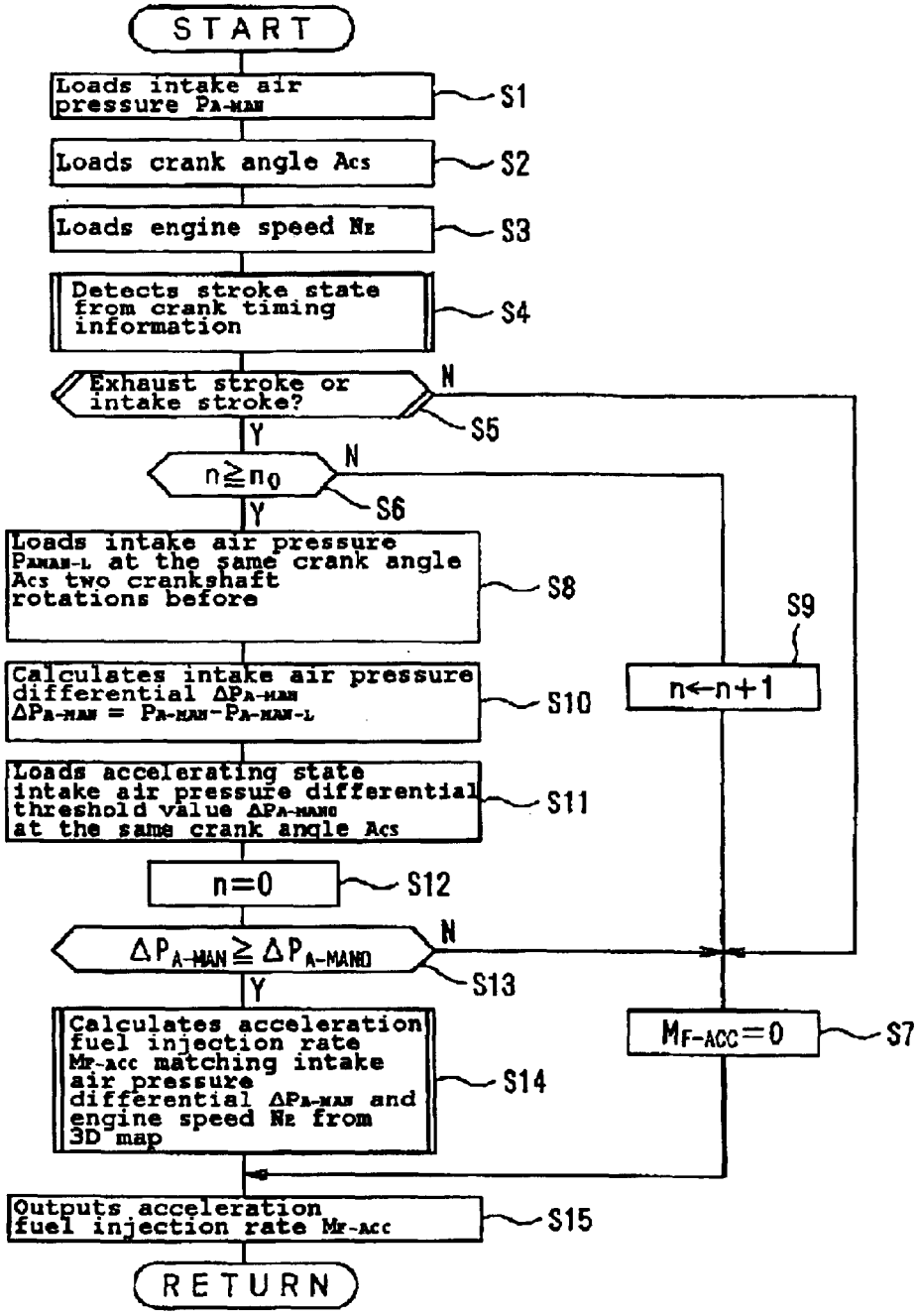
FIG. 7 is a flowchart of operation processes of detecting an accelerating state and calculating the acceleration fuel injection rate.

The accelerating state detecting section 41 and the acceleration fuel injection rate calculating section 42 work simultaneously to carry out the operation process shown in FIG. 7. This operation process is carried out every time a crank angle pulse signal of a specified crank angle set for example to 30 degrees comes in. Incidentally, while a special step for communication is not provided in this operation process, the information obtained by the operation process is stored in the memory device from time to time, and information required for the operation process is loaded from the memory device from time to time. In this operation process in particular, the intake air pressure loaded is stored and renewed, associated with the crank angle at the time, for two crankshaft rotations in the sequential memory device such as a shift register.

In this operation process, first in the step S1, an intake air pressure $P_{A\text{-}MAN}$ is loaded from the intake air pressure signal.

Next in the step S2, a crank angle $A_{CS}$ is loaded from the crank angle signal.

Next in the step S3, an engine speed $N_E$ is loaded from the engine speed calculating section 26.

Next in the step S4, a stroke state is detected from the crank timing information according to the individual operation process performed in the same step.

Next in the step S5, whether or not the current stroke is an exhaust stroke or an intake stroke is determined according to the individual operation process performed in the same step. If the stroke is in the exhaust or intake stroke, the process moves on to the step S6, and otherwise to the step S7.

In the step S6, determination is made whether or not an acceleration fuel injection prohibiting counter n is not smaller than a specified value $n_0$ that permits acceleration fuel injection. If the acceleration fuel injection prohibiting counter n is not smaller than the specified value $n_0$, the process moves on to the step S8, and otherwise to the step S9.

In the step S8, an intake air pressure $P_{A\text{-}MAN\text{-}L}$ at the same crank angle $A_{CS}$ two crankshaft rotations earlier, or in the same stroke in the previous cycle (hereinafter described also as a previous intake air pressure value) is loaded, and the process moves on to the step S10.

In the step S10, the previous intake air pressure value $P_{A\text{-}MAN\text{-}L}$ is subtracted from the current intake air pressure $P_{A\text{-}MAN}$ loaded in the step S1 to calculate an intake air pressure differential $\Delta P_{A\text{-}MAN}$ and the process moves on to the step S11.

In the step S11, an accelerating state intake air pressure differential threshold value $\Delta P_{A\text{-}MAN0}$ at the same crank angle $A_{CS}$ is loaded from the accelerating state threshold value table according to the individual operation process performed in the same step, and the process moves on to the step S12.

In the step S12, the acceleration fuel injection prohibiting counter n is cleared, and the process moves on to the step S13.

In the step S13, determination is made whether or not the intake air pressure differential $\Delta P_{A\text{-}MAN}$ calculated in the step S10 is not smaller than the accelerating state intake air pressure differential threshold value $\Delta P_{A\text{-}MAN0}$ at the same crank angle $A_{CS}$ loaded in the step S11. If the intake air pressure differential $\Delta P_{A\text{-}MAN}$ is not smaller than the accelerating state intake air pressure differential threshold value $\Delta P_{A\text{-}MAN0}$, the process moves on to the step S14, and otherwise to the step S7.

In the step S9, the acceleration fuel injection prohibiting counter n is incremented, and the process moves on to the step S7.

In the step S14, an acceleration fuel injection rate $M_{F\text{-}ACC}$ matching the intake air pressure differential $\Delta P_{A\text{-}MAN}$ calculated in the step S10 and the engine speed $N_E$ loaded in the step S3 is calculated from a three-dimensional map according to the individual operation process performed in the same step, and the process moves on to the step S15.

In the step S7, the acceleration fuel injection rate $M_{F\text{-}ACC}$ is set to zero before moving on to the step S15.

In the step S15, the acceleration fuel injection rate $M_{F\text{-}ACC}$ set in the step S14 or S7 is outputted before returning to the main program.

According to this embodiment, fuel for acceleration is injected when an accelerating state is detected with the accelerating state detecting section 41. That is to say, fuel is injected immediately when determination is made in the step S13 of the operation process shown in FIG. 7 that the intake air pressure differential $\Delta P_{A\text{-}MAN}$ is not smaller than the accelerating state intake air pressure differential threshold value $\Delta P_{A\text{-}MAN0}$. In other words, fuel for acceleration is injected when an accelerating state is detected.

The ignition timing setting section 31 is made up of: a basic ignition timing calculating section 36 for calculating basic ignition timing based on the engine speed calculated with the engine speed calculating section 26 and on the target air-fuel ratio calculating section 33, and an ignition timing correcting section 38 for correcting the basic ignition timing calculated with the basic ignition timing calculating section 36 according to the acceleration fuel injection rate calculated with the acceleration fuel injection rate calculating section 42.

The basic ignition timing calculating section 36, using a map for searching ignition timing, calculates the basic ignition timing that produces maximum torque at the current engine speed and the target air-fuel ratio at the time. In other words, the basic ignition timing calculated with the basic ignition timing calculating section 36, like the regular fuel injection rate calculating section 34, is based on the result of the intake stroke one cycle earlier. The ignition timing correcting section 38 corrects the ignition timing as follows: according to the acceleration fuel injection rate calculated with the acceleration fuel injection rate calculating section 42; an in-cylinder air-fuel ratio when the acceleration fuel injection rate is added to the regular fuel injection rate is determined; when the in-cylinder air-fuel ratio is greatly different from the target air-fuel ratio set with the regular target air-fuel ratio calculating section 33; and new ignition timing is set using the in-cylinder air-fuel ratio, the engine speed, and the intake air pressure.

Figure 8:
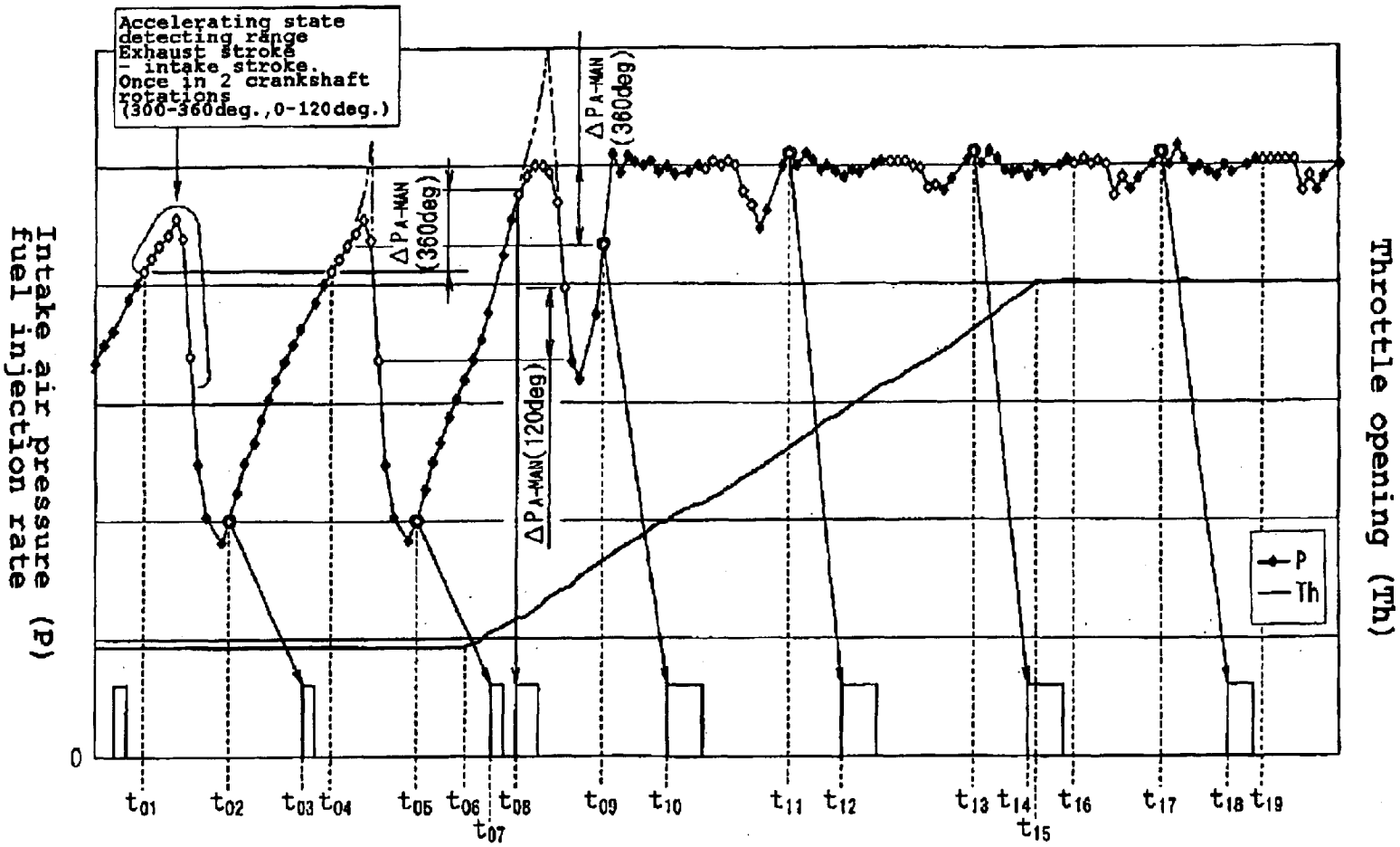
FIG. 8 is a timing chart showing the function of the operation processes shown in FIG. 7.

Next, the function of the operation process shown in FIG. 7 is described along with the timing chart shown in FIG. 8. According to this timing chart, the throttle opening is constant for a period of time up to $t_{06}$. The throttle is opened linearly within a relatively short period of time from $t_{06}$ to $t_{15}$ before becoming constant again. This embodiment is arranged that the intake valve is open from slightly before the exhaust top dead center to slightly after the compression bottom dead center. The curve plotted with diamonds in the graph shows the intake air pressure. The waveform of pulses at the bottom of the graph shows the amount of injected fuel. As described before, the intake air pressure suddenly decreases in the intake stroke, which is followed in order by the compression stroke, the expansion (combustion) stroke, and the exhaust stroke to complete a cycle that is repeated.

The diamond-shaped plotting marks on the intake air pressure curve show pulses at crank angle intervals of 30 degrees. At the crank angle position surrounded with a circle (240 degrees), the target air-fuel ratio matching the engine speed is set. At the same time, the regular fuel injection rate and the fuel injection timing are set using the intake air pressure detected at the time. According to this timing chart, fuel of the regular fuel injection rate set at the time $t_{02}$ is injected at the time $t_{03}$. In the same way thereafter, fuel injection rate is set at the time $t_{05}$ and injected at the time $t_{07}$, set at the time $t_{09}$ and injected at the time $t_{10}$, set at the time $t_{11}$ and injected at the time $t_{12}$, set at the time $t_{13}$ and injected at the time $t_{14}$, and set at the time $t_{17}$ and injected at the time $t_{18}$. Of these, for example, the regular fuel injection rate set at the time $t_{09}$ and injected at the time $t_{10}$ is greater than the previous regular fuel injection rate because the intake air pressure is already high and accordingly a large intake air rate is calculated. However, since the regular fuel injection rate is generally set in the compression stroke and the regular fuel injection timing is set in the exhaust stroke, the driver's intention of acceleration is not reflected in real time in the regular fuel injection rate. In other words, while the throttle starts opening at the time $t_{06}$, since the regular fuel injection rate at the time $t_{07}$ is already set at the time $t_{05}$ before the time $t_{06}$, the injection rate is smaller than intended for acceleration.

According to this embodiment, on the other hand, by the operation process shown in FIG. 7, the intake air pressure $P_{A\text{-}MAN}$ at a crank angle plotted with an open diamond in FIG. 8 is compared with that at the same crank angle of the previous cycle to calculate the differential value as the intake air pressure differential $\Delta P_{A\text{-}MAN}$, and the value is compared with the threshold value $\Delta P_{A\text{-}MAN0}$. For example, when intake air pressures $P_{A\text{-}MAN(300\ deg)}$ at the crank angle of 300 degrees, at the times $t_{01}$ and $t_{04}$ or at the times $t_{16}$ and $t_{19}$ when the throttle opening remains constant, are compared with each other, both values are almost the same, that is, the difference between the previous and current values, or the intake air pressure differential value $\Delta P_{A\text{-}MAN}$, is small. However, the intake air pressure $P_{A\text{-}MAN(300\ deg)}$ at the time $t_{08}$ at the crank angle of 300 degrees, at which the throttle opening increases, is greater than the intake air pressure $P_{A\text{-}MAN(300\ deg)}$ at the time $t_{04}$ in the previous cycle at the crank angle of 300 degrees, at which the throttle opening is still small. Therefore, the intake air pressure differential $\Delta P_{A\text{-}MAN(300\ deg)}$ obtained by subtracting the intake air pressure $P_{A\text{-}MAN(300\ deg)}$ at the time $t_{04}$ from the intake air pressure $P_{A\text{-}MAN(300\ deg)}$ at the time $t_{08}$ is compared with the threshold value $\Delta P_{A\text{-}MAN0(300\ deg)}$. If the intake air pressure differential $\Delta P_{A\text{-}MAN(300\ deg)}$ is greater than the threshold value $\Delta P_{A\text{-}MAN0(300\ deg)}$, an accelerating state is detected to be present.

Incidentally, detecting the accelerating state using the intake air pressure differential $\Delta P_{A\text{-}MAN}$ is more distinct in the intake stroke. For example, the intake air pressure differential $\Delta P_{A\text{-}MAN(120\ deg)}$ at the crank angle of 120 degrees in the intake stroke is likely to show itself clearly. However, depending on the engine characteristics, as shown for example by a chain double-dashed line in FIG. 8, there is a possibility that the intake air pressure curve shows steep, so-called peaky characteristics, and disagreement is present in the detected crank angle and the intake air pressure. This can result in disagreement in the calculated intake air pressure. Therefore, the range of detecting the accelerating state is extended to the exhaust stroke in which the intake air pressure curve is relatively less steep to detect the accelerating state using the intake air pressure differential in both strokes. As a matter of course, it may be arranged that the accelerating state is detected in only one of the strokes depending on the engine characteristics.

In the four-stroke engine used in this embodiment, the exhaust stroke and the intake stroke occur only once each in two crankshaft rotations. Therefore, in the motorcycle engine as used in this embodiment without a cam sensor, which of those strokes the engine is in cannot be found by simply detecting the crank angle. Therefore, the detection of an accelerating state using the intake air pressure differential $\Delta P_{A\text{-}MAN}$ is carried out after determining which of those strokes by loading the stroke state based on the crank timing information detected with the crank timing detecting section 27. This makes it possible to detect the accelerating state more reliably.

While it is not clear with the intake air pressure differential $\Delta P_{A\text{-}MAN(300deg)}$ at the crank angle of 300 degrees and the intake air pressure differential $\Delta P_{A\text{-}MAN(120deg)}$ at the crank angle of 120 degrees, as is clear by comparing with the intake air pressure differential $\Delta P_{A\text{-}MAN(360deg)}$ at the crank angle of 360 degrees as shown in FIG. 8, the intake air pressure differential $\Delta P_{A\text{-}MAN}$, which is the difference between the previous and current values, is different at each of different crank angles even if the throttle opening is the same. Therefore, the accelerating state intake air pressure differential threshold value $\Delta P_{A\text{-}MAN0}$ must be changed at every crank angle $A_{CS}$. Therefore, this embodiment is arranged to store a table of the accelerating state intake air pressure differential threshold values $\Delta P_{A\text{-}MAN0}$ for every crank angle $A_{CS}$ to detect the accelerating state. The threshold value $\Delta P_{A\text{-}MAN0}$ is loaded for every crank angle and compared with the intake air pressure differential $\Delta P_{A\text{-}MAN}$. This makes it possible to detect the accelerating state more accurately.

This embodiment is arranged to inject fuel of the acceleration fuel injection rate $M_{F\text{-}ACC}$ according to the engine speed $N_E$ and the intake air pressure differential $\Delta P_{A\text{-}MAN}$ immediately after the accelerating state is detected at the time $t_{08}$. It is a very common practice to set the acceleration fuel injection rate $M_{F\text{-}ACC}$ according to the engine speed $N_E$. Normally, the higher the engine speed, the smaller the fuel injection rate is set. Since the intake air pressure differential $\Delta P_{A\text{-}MAN}$ is proportional to the change in the throttle opening, the fuel injection rate is increased according to the increase in the intake air pressure differential. Even if the increased amount of fuel is injected, knocking due to too low an air-fuel ratio cannot occur because the intake air pressure is already high and air is drawn in at a higher rate in the next intake stroke. This embodiment is arranged to inject fuel for acceleration immediately after detecting an accelerating state, so that it is possible to control the air-fuel ratio in the cylinder that is about to start a combustion stroke to a value matching the accelerating state and to set the acceleration fuel injection rate commensurate with the engine speed and the intake air pressure differential, so that the driver can get acceleration feeling as intended.

This embodiment is also arranged to detect an accelerating state and, after injecting fuel from the fuel injection device at an acceleration fuel injection rate, not to inject fuel for acceleration until the acceleration fuel injection prohibiting counter n reaches or exceeds a specified value $n_0$ at which fuel injection for acceleration is permitted. Therefore, it is possible to prevent the air-fuel ratio in the cylinder from becoming too rich due to repeated fuel injection for acceleration.

This embodiment, which determines a stroke and detects an accelerating state or an engine load from an intake air pressure, requires that the intake air pressure changes smoothly according to strokes as shown in FIG. 3. In other words, if the intake air pressure values contain noises, the accelerating state may not be detected accurately by comparing the intake air pressure values of the same crank phase between the previous and current strokes. In contrast, in the case an intake air flow rate, which also represents an engine load, is calculated from the intake air pressure, changes in the intake air pressure that are somewhat real according to strokes are required. Generally, removal of noises makes values averaged due to the damping effect. As a result, instantaneous values of the intake air pressure that are necessary for calculating the intake air flow rate cannot be obtained.

Figure 9:
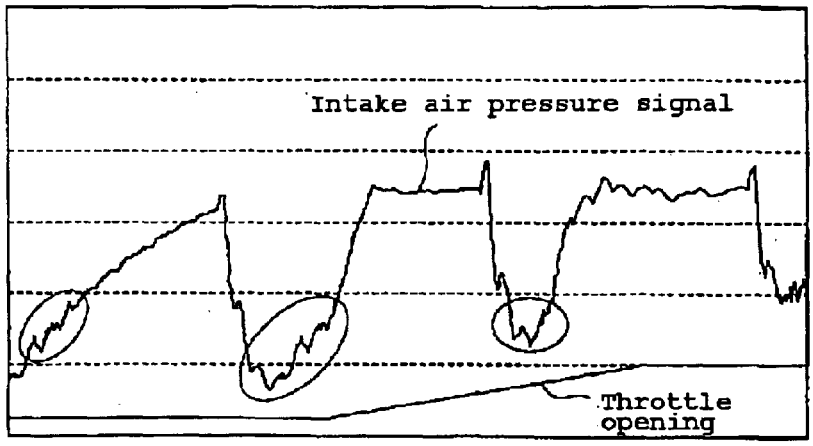
FIG. 9 is an explanatory drawing of intake air pressure signals detected with the intake air pressure sensor.
Figure 10:
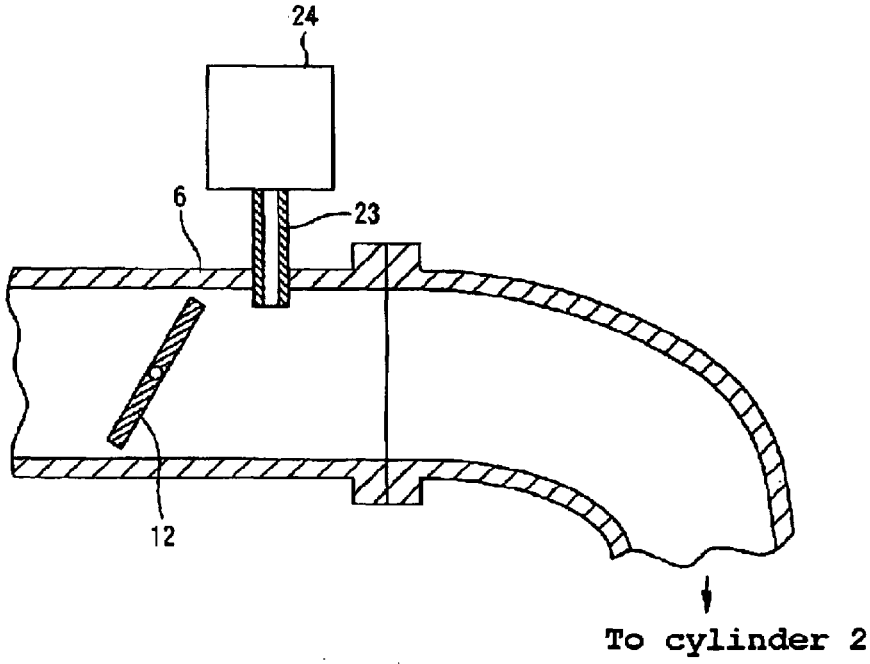
FIG. 10 is an explanatory drawing of the state of attaching the intake air pressure sensor to the intake pipe.
Figure 11:
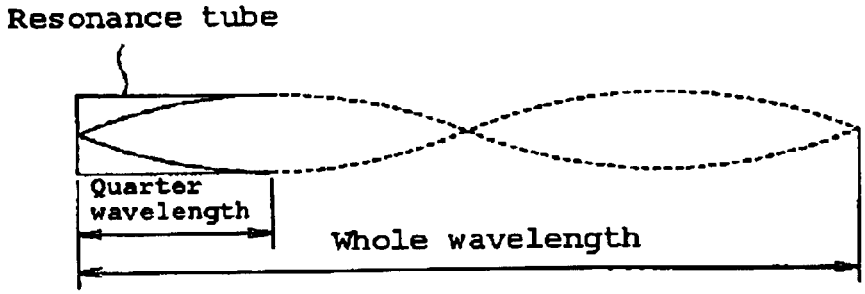
FIG. 11 is an explanatory drawing of air column vibration.

FIG. 9 shows a true depiction of the intake air pressure signals outputted from the intake air pressure sensor 24. This curve includes, in addition to electric noises, special vibration as seen for example in the encircled parts. To prevent the intake air pressure sensor 24 from being wetted directly with fuel, the intake air pressure sensor 24 is attached to a pressure guide pipe 23, which is attached to the intake pipe 6, as shown in FIG. 10. It has proven that the pressure guide pipe 23 and the intake air pressure sensor 24 constitute a resonance tube to produce air column vibration, which causes special vibration superimposed on the intake air pressure signals mentioned above. Since the wavelength of the air column vibration is four times the length of the resonance tube as shown in FIG. 11, the frequency of the air column vibration superimposed on the intake air pressure signals is the frequency corresponding to the wavelength that is four times the length of the pressure guide pipe 23. That is, the frequency of the air column vibration is obtained by dividing the sound velocity by the wavelength that is four times the length of the pressure guide pipe 23.

Therefore, the cutoff frequency of the low-pass filter 14 for removing the air column vibration must be not higher than the frequency that corresponds to the wavelength that is four times the length of the pressure guide pipe 23. As shown in FIG. 9, since the frequency of electric noises is higher than the air column vibration frequency, the electric noises are also cut off with the above cutoff frequency. While this embodiment is capable of obtaining real changes in the intake air pressure by detecting the intake air pressure for each cylinder (only one for a single cylinder engine) of the independent intake type four-stroke engine, if the cutoff frequency of the low-pass filter 14 is set too low, the intake air pressure signals are made averaged and it becomes impossible to obtain real intake air pressure changes needed for determining strokes and detecting the intake air flow rate. Therefore, the lower limit of the cutoff frequency of the low-pass filter 14 is set to the driving frequency of the intake valve. Incidentally, while there are cases in which the upper limit of the cutoff frequency of the low-pass filter 14 is unnecessary depending on the method of attaching the intake air pressure sensor or the performance of the sensor, the lower limit of the cutoff frequency is always necessary irrespective of the type or the attaching method of the sensor.

Figure 12:
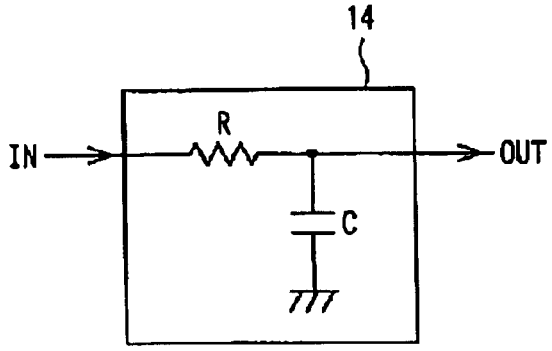
FIG. 12 is an explanatory drawing of the constitution of an analog low-pass filter.

The low-pass filter 14 constituted of an analog circuit is shown for example in FIG. 12. Here, assuming that the low-pass filter 14 is constituted with a resistor of a resistance value R and a capacitor of a capacitance value C, the cutoff frequency $f_c$ of the low-pass filter 14 is given as $(1/(2\pi RC))$. Therefore, the cutoff frequency $f_c$ of the low-pass filter 14 can be adjusted by appropriately setting the resistance value R and the capacitance C shown for example in FIG. 12. As a matter of course, a so-called digital low-pass filter may be used that carries out the low-pass filtering by an operation process. In that case, the low-pass filter of the analog circuit is made discrete.

Figure 13:
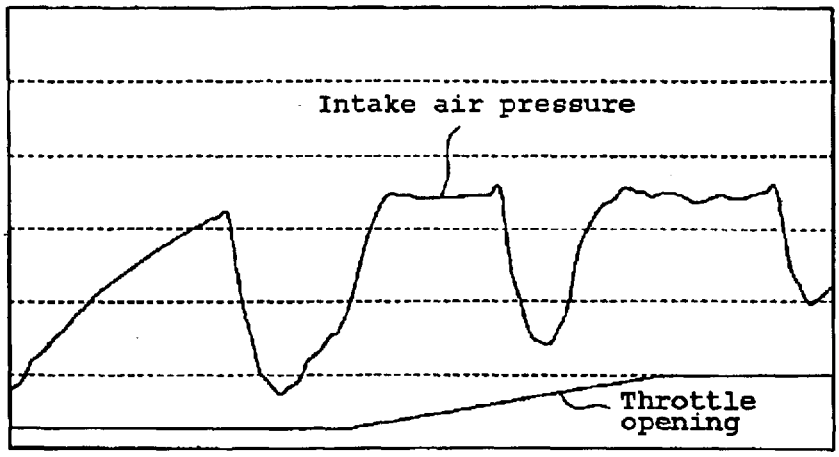
FIG. 13 is an explanatory drawing of the intake air pressure signals processed with the low-pass filter.

FIG. 13 shows a waveform of the intake air pressure signals after the low-pass filtering process with the low-pass filter 14 having the above-mentioned cutoff frequency characteristics. As is clear from the drawing, electric noises and air column vibration are removed and still the changes in the intake air pressure associated with strokes appear in a real manner. This makes it possible to carry out the determination of the accelerating state and the calculation of the intake air flow rate more accurately.

While details of this embodiment are described in relation to the engine of the intake pipe injection type, the engine controller of this invention may be likewise applied to engines of the direct injection type. However, since the direct injection engine has no possibility of fuel adhering to the intake pipe, the total amount of fuel injected may be used for calculating the air-fuel ratio, which omits taking the possibility into consideration.

Moreover, while the above embodiment is described in detail in relation to the engine having four cylinders or the so-called multi-cylinder engine, the engine controller of this invention may be likewise applied to engines having a single cylinder because the invention is intended for independent intake four-stroke engines.

Furthermore, the microcomputer of the engine control unit may be substituted by an operation circuit of various types.

INDUSTRIAL USABILITY

As described above, the claim 1 of the present invention relates to an engine controller for controlling the operating state of a four-stroke engine according to the engine load detected from the intake air pressure in the intake pipe of the engine detected with a pressure sensor. The engine controller is provided with a low-pass filter to apply low-pass filtering process to the intake air pressure signals detected with the pressure sensor. Since the low-pass filter is set to cut off frequencies that are not lower than the driving frequency of the intake valve, noises are removed from the intake air pressure signals and smooth changes in the intake air pressure are detected. Therefore, it is possible to detect accurately the engine load including the accelerating state and the intake air flow rate.

The claim 2 of the present invention relates to an engine controller for controlling the operating state of a four-stroke engine according to the engine load detected from the intake air pressure in the intake pipe of the engine detected with a pressure sensor. The engine controller is provided with a low-pass filter to apply low-pass filtering process to the intake air pressure signals detected with the pressure sensor. The low-pass filter is set to cut off frequencies that are not higher than the frequency corresponding to the wavelength that is four times the length of a pressure guide pipe interconnecting the pressure sensor and the intake pipe and to cut off frequencies that are not lower than the driving frequency of the intake valve. Therefore, it is possible to detect smooth and linear changes in the intake air pressure and to detect accurately the engine load including the accelerating state and the intake air flow rate.

What is claimed is:

1. An engine controller for controlling the operating state of a four-stroke engine of the independent intake type according to the engine load detected from the intake air pressure in the intake pipe of the engine detected with a pressure sensor, characterized in that a low-pass filter is provided to apply low-pass filtering process to the intake air pressure signals detected with the pressure sensor, with the low-pass filter set to cut off frequencies that are not higher than the frequency corresponding to the wavelength that is at least greater than the length of a pressure guide pipe interconnecting the pressure sensor and the intake pipe.

2. The engine controller of claim 1, wherein the pressure guide pipe is attached to the intake pipe, and wherein the pressure sensor is attached to the pressure guide pipe.

3. The engine controller of claim 1, wherein the pressure guide pipe is interposed between the intake pipe and the pressure sensor so that the pressure guide pipe prevents the pressure sensor from being wetted directly with fuel from the intake pipe.

4. The engine controller of claim 1, wherein the pressure guide pipe and the intake air pressure sensor comprise a resonance tube that produces air column vibration.

5. The engine controller of claim 4, wherein the wavelength of the air column vibration is at least four times the length of the resonance tube.

6. The engine controller of claim 5, wherein the frequency of the air column vibration superimposed on the intake air pressure signals comprises the frequency corresponding to the wavelength that is at least four times the length of the pressure guide pipe.

7. The engine controller of claim 6, wherein the low-pass filter is set to cut off frequencies that are not higher than the frequency corresponding to the wavelength that is at least four times the length of a pressure guide pipe.

8. The engine controller of claim 1, wherein the low-pass filter comprises an adjustable analog circuit including at least one resistor and at least one capacitor that are adapted to provide a cut-off frequency ($f_c$).

9. An engine controller for controlling the operating state of a four-stroke engine of the independent intake type according to the engine load detected from the intake air pressure in the intake pipe of the engine detected with a pressure sensor, characterized in that a low-pass filter is provided to apply low-pass filtering process to the intake air pressure signals detected with the pressure sensor, with the low-pass filter set to cut off frequencies that are not higher than the frequency corresponding to the wavelength that is four times the length of a pressure guide pipe interconnecting the pressure sensor and the intake pipe and to cut off frequencies that are not lower than the driving frequency of the intake valve.

10. The engine controller of claim 9, wherein the pressure guide pipe is attached to the intake pipe, and wherein the pressure sensor is attached to the pressure guide pipe.

11. The engine controller of claim 9, wherein the pressure guide pipe is interposed between the intake pipe and the pressure sensor so that the pressure guide pipe prevents the pressure sensor from being wetted directly with fuel from the intake pipe.

12. The engine controller of claim 9, wherein the pressure guide pipe and the intake air pressure sensor comprise a resonance tube that produces air column vibration.

13. The engine controller of claim 9, wherein the wavelength of the air column vibration is at least four times the length of the resonance tube.

14. The engine controller of claim 13, wherein the frequency of the air column vibration superimposed on the intake air pressure signals comprises the frequency corresponding to the wavelength that is at least four times the length of the pressure guide pipe.

15. The engine controller of claim 14, wherein the low-pass filter is set to cut off frequencies that are not higher than the frequency corresponding to the wavelength that is at least four times the length of a pressure guide pipe.

16. The engine controller of claim 9, wherein the low-pass filter comprises an adjustable analog circuit including at least one resistor and at least one capacitor that are adapted to provide a cut-off frequency ($f_c$).

* * * * *